US006922120B2

(12) United States Patent
Lee et al.

(10) Patent No.: US 6,922,120 B2
(45) Date of Patent: Jul. 26, 2005

(54) DIELECTRIC FILTER, DUPLEXER DIELECTRIC FILTER, AND METHOD FOR MANUFACTURING THE SAME

(75) Inventors: Hong Seok Lee, Kyungki-do (KR); Su Kil Lee, Kyungki-do (KR)

(73) Assignee: Samsung Electro-Mechanics Co., Ltd., Kyungki-Do (KR)

( * ) Notice: Subject to any disclaimer, the term of this patent is extended or adjusted under 35 U.S.C. 154(b) by 26 days.

(21) Appl. No.: 10/329,512

(22) Filed: Dec. 27, 2002

(65) Prior Publication Data

US 2004/0095213 A1 May 20, 2004

(30) Foreign Application Priority Data

Nov. 19, 2002 (KR) ..... 10-2002-0071938

(51) Int. Cl.[7] ..... H01P 3/06

(52) U.S. Cl. ..... 333/207; 333/206; 333/223; 333/202

(58) Field of Search ..... 333/206, 207, 333/223, 222, 202

(56) References Cited

U.S. PATENT DOCUMENTS 4,808,951 A * 2/1989 Yamato et al. ..... 333/202
5,525,946 A * 6/1996 Tsujiguchi et al. ..... 333/202
5,642,084 A * 6/1997 Matsumoto et al. ..... 333/202
5,945,896 A * 8/1999 Miyamoto ..... 333/206
6,008,707 A * 12/1999 Tada et al. ..... 333/134

* cited by examiner

*Primary Examiner*—Robert Pascal
*Assistant Examiner*—Kimberly Glenn
(74) *Attorney, Agent, or Firm*—Lowe Hauptman & Berner, LLP

(57) ABSTRACT

A method of manufacturing a dielectric filter comprises the steps of: forming a dielectric block; depositing a conductor on the side surfaces and the second surface of the dielectric block, and forming a plurality of resonators, forming input and output terminals on the side surface of the dielectric block, and forming conductive patterns on at least a part of the area of the first surface; and depositing a thermosetting resin on the first surface provided with the conductive patterns, and curing the thermosetting resin. The dielectric filter comprising the protection layer on an open surface prevents defects such as a short circuit generated in a trimming step. The interval between the patterns is reduced to less than 0.04 mm, advantageously facilitating miniaturization of the dielectric filter.

16 Claims, 5 Drawing Sheets

DIELECTRIC FILTER, DUPLEXER DIELECTRIC FILTER, AND METHOD FOR MANUFACTURING THE SAME

BACKGROUND OF THE INVENTION

1. Field of the Invention

The present invention relates to a dielectric filter and a method for manufacturing the same, and more particularly to a dielectric filter in which electrodes are formed on an open surface of a dielectric block and deposited with a thermosetting resin thereon, thereby preventing defects such as a short circuit caused by burrs generated during a subsequent tuning step, and a method for manufacturing the dielectric filter.

2. Description of the Related Art

Recently, in order to satisfy the trend toward miniaturization of mobile communication terminals, electronic components incorporated into mobile communication terminals are also required to be miniaturized.

Dielectric filters are generally used as duplexers being essential components of the mobile communication terminals. However, recently, SAW (Surface Acoustic Wave) filters or FBARs (Film Bulk Acoustic Resonators) being advantageous in terms of miniaturization have been increasingly substituted for the dielectric filters. Compared to other types of high-frequency filters, the dielectric filters are advantageous in terms of thermal stability, electrical resistance, and competitive pricing, and have a low loss factor. In view of the aforementioned characteristics of the dielectric filters, the dielectric filters have been steadily developed toward small, thin, and light characteristics, i.e., miniaturization.

Conventionally, in order to achieve the miniaturization of the dielectric filter, the dielectric filter is formed such that a dielectric block has a small thickness and an interval between resonant holes formed in the dielectric block is narrow. However, as a result, the dimensions of the dielectric filter are reduced, and simultaneously a line width of conductive patterns and an interval between the conductive patterns become narrow. Herein, the line width and the interval of the conductive patterns are factors determining electrical characteristics of the dielectric filter.

Due to the reduced line width and interval of the conductive patterns, it is difficult to trim the conductive patterns during a tuning step for adjusting resonant frequency.

Particularly, in case of an open surface of the dielectric filter, fine metal segments (hereinafter, referred to as "burr") generated in trimming the conductive patterns are located at open areas between the conductive patterns, thereby causing electrical defects (e.g., a short circuit). These electrical defects change the resonant frequency and finally output defective products. The generation of burrs not only prevents the miniaturization of the dielectric filter, but also causes many problems in a trimming step of the conventional miniaturized dielectric filter performed by manufacturers or users.

Hereinafter, with reference to FIG. 1, the generation of burrs caused during a trimming step of conductive patterns will be described in detail.

As shown in FIG. 1, a duplexer dielectric filter 10 comprises a dielectric block 11 having resonant holes 15 passing through two opposite surfaces. An open surface 13 of the dielectric block 11 is provided with input and output terminals 21 and 23, an antenna terminal 22, and conductive patterns 25 and 29 having various shapes. The input and output terminals 21 and 23, and the antenna terminal 22 are extended to a side surface adjacent to the open surface 13 being separated from a conductive material formed on the side surface. The conductive patterns 25 and 29 provide a desired resonant frequency to the duplexer dielectric filter 10 according to sizes and intervals of the conductive patterns 25 and 29. For example, the conductive patterns 25 formed on the open surface 13 around the resonant holes 15 and connected to a conductive material deposited within the resonant holes 15 form loading capacitances between the conductive material formed on the side surfaces of the dielectric block 11 and coupling capacitances between the neighboring resonators.

After forming the conductive patterns 25 and 29, the dielectric block 11 is fired. During the firing step, the dielectric constant of the dielectric block 11 is changed, and thus the resonant frequency of the dielectric filter 10 is changed. Therefore, a tuning step for correcting this change of resonant frequency is required. On the other hand, the resonant frequency of the dielectric filter 10 may be intentionally changed according to users' demands.

As aforementioned, after producing the final products, manufacturers or users perform a turning step for trimming the conductive patterns formed on the open surface of the dielectric block so as to form a desired resonant frequency.

However, as shown in FIG. 1, in the trimming step, when a part 25*a* of the conductive patterns 25 formed around the resonant holes 15 is removed, a metal segment 25*a*' is cut from the part 25*a* and disposed on an area of the open surface, thereby causing unintentional electrical defects. Particularly, as shown in the drawing, in case the metal segment 25*a* is disposed between the separated patterns 25 and 29, the metal segment 25*a*' causes a short circuit therebetween. The short circuit may cause a fatal defect to the products.

The aforementioned problem is more severe in a miniaturized dielectric filter. Further, as the conductive patterns of the dielectric block become narrower, that is, as the dielectric block become smaller, the defect rate generated by the metal segments increases and limits the miniaturization of the dielectric filter.

SUMMARY OF THE INVENTION

Therefore, the present invention has been made in view of the above problems, and it is an object of the present invention to provide a dielectric filter comprising a protection layer made of a thermosetting resin on an open surface of a dielectric block so as to prevent unintentional electrical defects such as a short circuit even when metal segments generated during trimming of conductive patterns formed on the open surface are disposed between the conductive patterns, and a method for manufacturing the dielectric filter.

In accordance with one aspect of the present invention, the above and other objects can be accomplished by the provision of a dielectric filter having a designated resonant frequency, comprising: a dielectric block having a first surface, a second surface being opposite to the first surface, and side surfaces disposed between the first and second surfaces, the side surfaces and the second surface being deposited with a conductive material; a plurality of resonators including resonant holes passing through the first and second surfaces of the dielectric block, being arranged in parallel, and having interior surfaces being deposited with a conductor; input and output terminals formed on both sides of the side surfaces of the dielectric block being separated from the conductive material deposited on the side surfaces; conductive patterns formed on at least a part of the area of the first surface so that the resonators have a desired resonant frequency by changing capacitances of the resonators and/or between the resonators; and a protection layer formed on the first surface provided with the conductive patterns by depositing a thermosetting resin thereon.

In accordance with a further aspect of the present invention, there is provided a duplexer dielectric filter provided with a transmitting area and a receiving area, each having a designated resonant frequency, comprising: a dielectric block having a first surface, a second surface being opposite to the first surface, and side surfaces disposed between the first and second surfaces, the side surfaces and the second surface being deposited with a conductive material; a plurality of resonators divided into the transmitting and receiving areas, each including at least one resonant hole passing through the first and second surfaces of the dielectric block, being arranged in parallel, and having interior surfaces being deposited with a conductor; input and output terminals and an antenna terminal, formed on the first surface and extended to one side surface adjacent to the first surface of the dielectric block being separated from the conductive material deposited on the side surface; conductive patterns formed on at least a part of the area of the first surface so that the resonators have a desired resonant frequency by changing capacitances of the resonators and/or between the resonators of the transmitting area and/or the receiving area; and a protection layer formed on the first surface provided with the conductive patterns by depositing a thermosetting resin thereon.

In accordance with another aspect of the present invention, there is provided a method for manufacturing a dielectric filter having a designated resonant frequency, comprising the steps of: forming a dielectric block having a first surface, a second surface being opposite to the first surface, and side surfaces disposed between the first and second surfaces; depositing a conductor on the side surfaces and the second surface of the dielectric block, and forming a plurality of resonators including resonant holes passing through the first and second surfaces of the dielectric block, being arranged in parallel, and having interior surfaces deposited with a conductor; forming input and output terminals on the side surface of the dielectric block, and forming conductive patterns on at least a part of the area of the first surface so that the resonators have a desired resonant frequency by changing capacitances of the resonators and/or between the resonators; and depositing a thermosetting resin on the first surface provided with the conductive patterns, and curing the thermosetting resin.

In accordance with yet another aspect of the present invention, there is provided a method for manufacturing a duplexer dielectric filter provided with a transmitting area and a receiving area, each having a designated resonant frequency, comprising the steps of: forming a dielectric block having a first surface, a second surface being opposite to the first surface, and side surfaces disposed between the first and second surfaces; depositing a conductor on the side surfaces and the second surface of the dielectric block, and forming a plurality of resonators passing through the first and second surfaces of the dielectric block, being arranged in parallel, having interior surfaces being deposited with a conductor, and being divided into the transmitting and receiving areas; forming input and output terminals and an antenna terminal on the first surface so as to be extended to one side surface adjacent to the first surface of the dielectric block, and forming conductive patterns on at least a part of the area of the first surface so that the resonators have a desired resonant frequency by changing capacitances of the resonators and/or between the resonators of the transmitting area and/or the receiving area; and depositing a thermosetting resin on the first surface provided with the conductive patterns, and curing the thermosetting resin.

Preferably, the method for manufacturing a dielectric filter or a duplexer dielectric filter may further comprise the step of adjusting the resonant frequency of the dielectric filter by trimming the conductive patterns formed on the first surface of the dielectric block, after the step of depositing the thermosetting resin on the first surface and curing the thermosetting resin. Further, preferably, the step of forming conductive patterns on at least a part of the area of the first surface may further comprise the step of forming an open area on at least a part of the area of the second surface.

Moreover, preferably, the protection layer may be made of a thermosetting solder resist ink. In case of the method for manufacturing a duplexer dielectric filter, the thermosetting resin may be deposited on the first surface except for an area for being soldered to a printed circuit board when the duplexer dielectric filter is mounted on the printed circuit board, the area being adjacent to the side surface provided with the input and output terminals and the antenna terminal.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Now, preferred embodiments of the present invention will be described in detail with reference to the annexed drawings.

Figure 1:
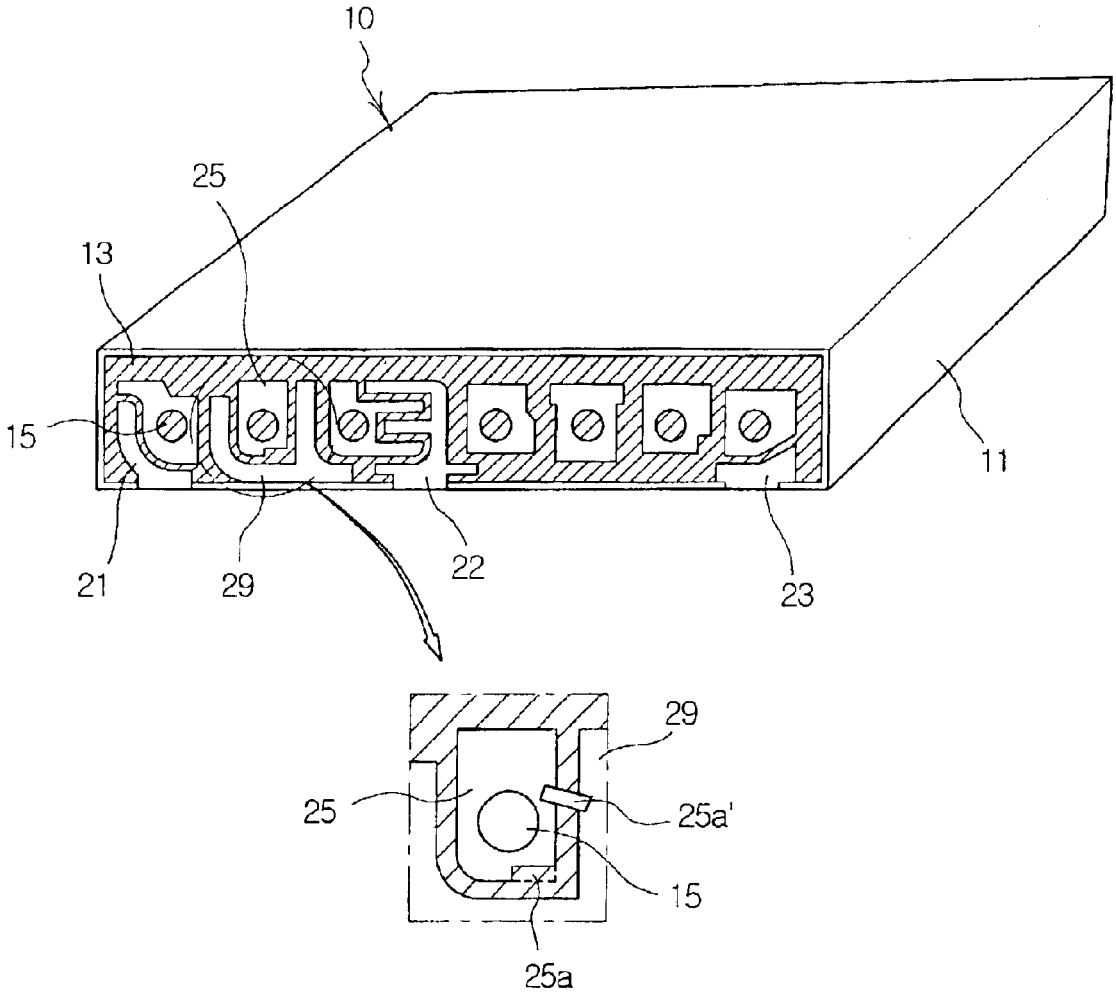
PRIOR ART FIG. 1
FIG. 1 is a schematic perspective view of a conventional duplexer dielectric filter.
Figure 2A:
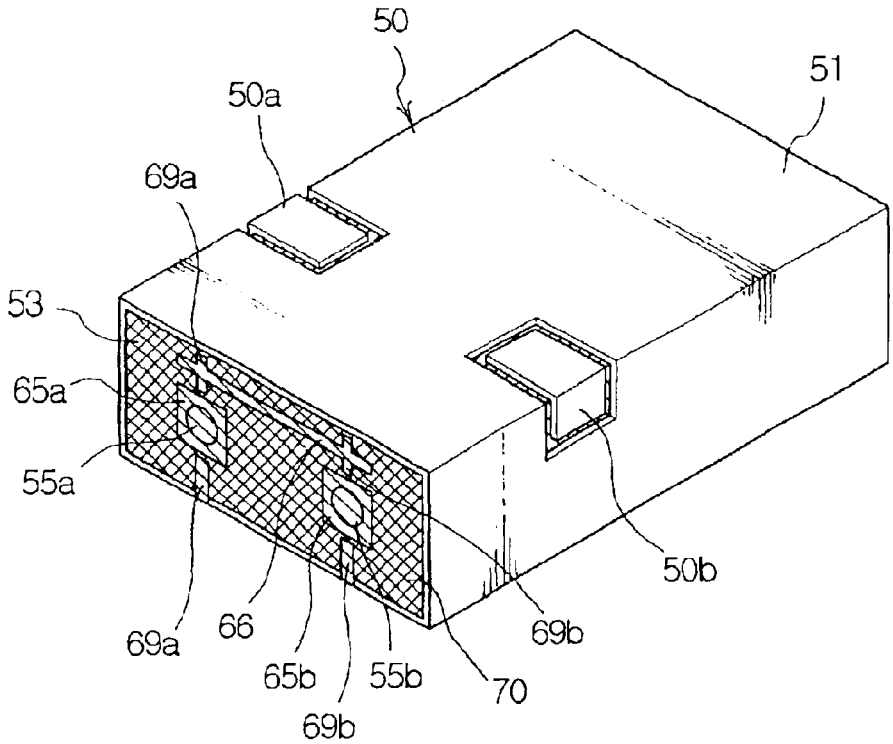
FIGS. 2*a* and 2*b* are a schematic perspective view and a front view of a dielectric filter in accordance with the present invention.
Figure 2B:
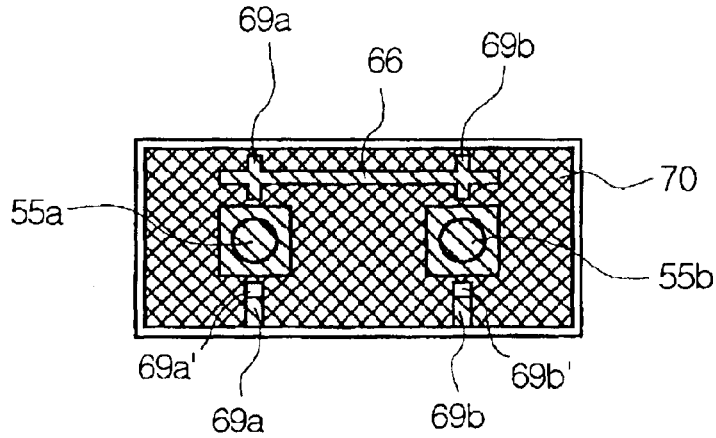

FIGS. 2*a* and 2*b* are a schematic perspective view and a front view of a dielectric filter in accordance with the present invention.

As shown in FIG. 2*a,* a dielectric filter 50 comprises a dielectric block 51 including a first surface 53, a second surface being opposite to the first surface 53, and four side surfaces disposed therebetween. Resonant holes 55*a* and 55*b* pass through the first surface 53 and the second surface of the dielectric block 51 and are arranged in parallel, and a conductive material is deposited on interior surfaces of the resonant holes 55*a* and 55*b*. Further, a conductive material is deposited wholly on the second and side surfaces of the dielectric block 51. Input and output terminals 50*a* and 50*b* are formed on the side surfaces of the dielectric block 51 being separated from the conductive material deposited on the side surfaces.

The dielectric filter 50 having the aforementioned structure forms a desired frequency by forming designated conductive patterns on the open first surface 53.

With reference to FIG. 2*a,* the conductive patterns 65*a,* 65*b,* 66, 69*a,* and 69*b* are formed on the first surface 53 of the dielectric block 51. The first conductive patterns 65*a* and 65*b* are formed around the resonant holes 55*a* and 55*b* being connected to the conductor within the resonant holes 55*a* and 55*b*. The first conductive patterns 65*a* and 65*b* form loading capacitances between the conductive material formed on the side surfaces of the dielectric block 51 and coupling capacitances between the neighboring resonators. The second conductive pattern 66 is formed above the resonant holes 55*a* and 55*b* in a direction of arranging the resonant holes 55*a* and 55*b* as a strip line, thereby forming coupling capacitances between the resonators.

The third conductive patterns 69*a* and 69*b* are extended from the resonant holes 55*a* and 55*b* in a lengthwise direction. The third conductive patterns 69*a* and 69*b* are formed in various shapes. That is, like the third conductive patterns 69*a* and 69*b* disposed on the resonant holes 55*a* and 55*b,* the third conductive patterns 69*a* and 69*b* may be formed integrally with the second conductive pattern 66. Otherwise, like the third conductive patterns 69*a* and 69*b* disposed under the resonant holes 55*a* and 55*b,* the third conductive patterns 69*a* and 69*b* may be connected to the conductive material disposed on the side surface of the dielectric block 51. Therefore, by forming various conductive patterns 65*a,* 65*b,* 66, 69*a,* and 69*b* on the open first surface 53 of the dielectric block 51, the dielectric filter 50 obtains a desired resonant frequency even though it is miniaturized.

However, as described above, the originally designated resonant frequency may be changed by the change of a dielectric constant of the dielectric block due to external impacts such as heat and pressure applied during the firing of the dielectric block in a manufacturing process of a dielectric filter. Otherwise, the originally designated resonant frequency of the dielectric filter may be properly adjusted according to users' demands. For these purposes, in order to adjust the resonant frequency during the manufacturing process of the dielectric filer and/or according to the users' demands, parts of the conductive patterns are properly selected and removed. This step is referred to as a trimming step, and by-products (referred to as "burr") generated during the trimming step are disposed on the open surface or between the two separated conductive patterns, thereby unintentionally generating short circuits.

In order to prevent such defects, the dielectric filter 50 of the present invention further comprises a protection layer 70 formed by depositing nonconductive thermosetting resin on the open first surface 53 provided with the conductive patterns 65*a,* 65*b,* 66, 69*a,* and 69*b*. The protection layer 70 is formed on the whole surface of the open first surface 53, thereby preventing the dielectric filter 50 from being electrically affected by metal segments generated in the trimming step and disposed at certain positions on the open first surface 53. A conventional thermosetting solder resist ink may be used as the thermosetting resin for forming the protection layer 70.

More specifically, with reference to FIG. 2*b,* the third conductive patterns 69*a* and 69*b* formed under the resonant holes 59*a* and 59*b* may be formed separately from other conductive patterns so as to serve as resonant frequency tunable conductive patterns for adjusting the resonant frequency. The resonant frequency tunable conductive patterns 69*a* and 69*b* are trimmed by forming conductive patterns with a designated size and selectively removing parts 69*a*' and 69*b*' of the conductive patterns.

Herein, although metal segments cut from the parts 69*a*' and 69*b*' are disposed on any position on the open first surface 53, the non-conductive protection layer 70 prevents the metal segments from being connected to the conductive pattern formed on the open first surface 53, thereby protecting the dielectric filter 50 from the undesirable electrical effects generated during the trimming step.

Figure 3:
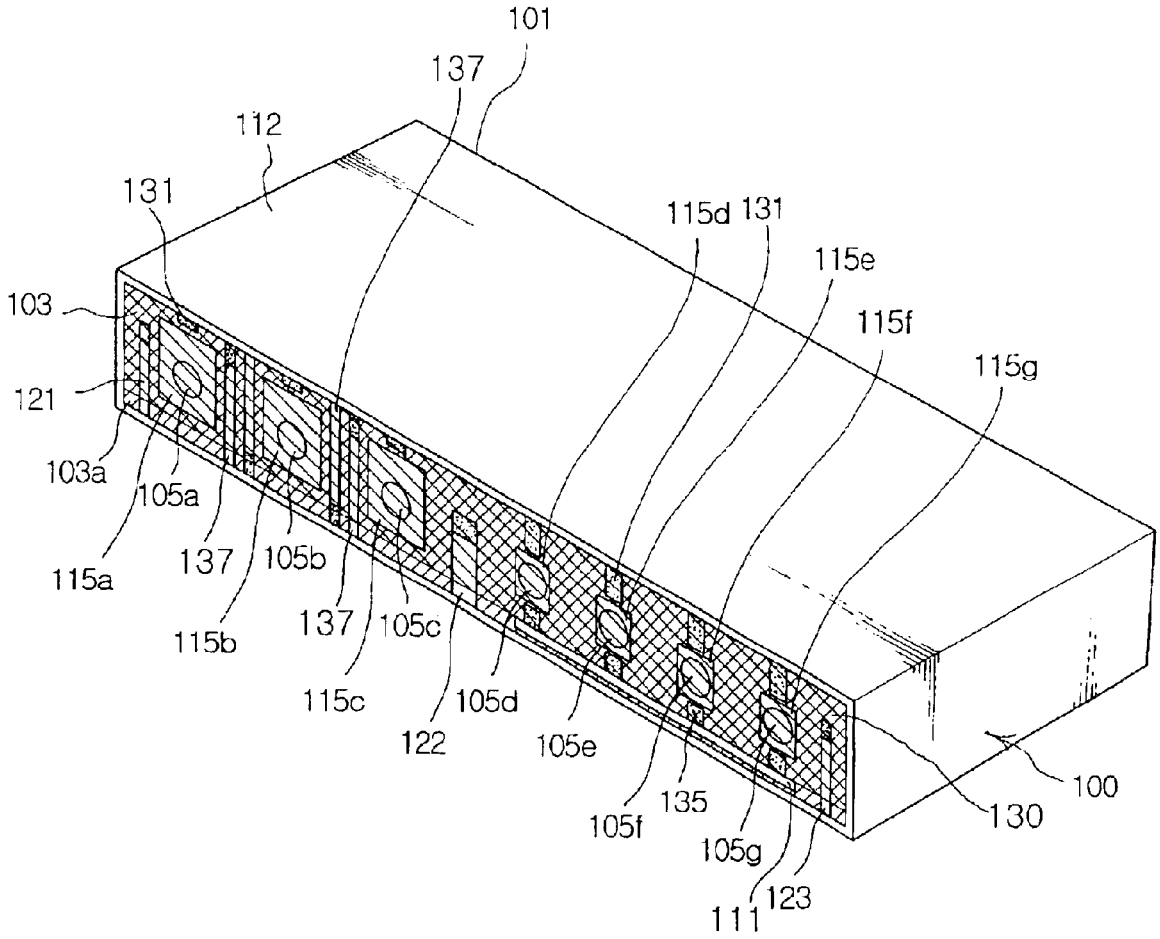
FIG. 3 is a schematic perspective view of a duplexer dielectric filter in accordance with the present invention.

The protection layer 70 formed on the open first surface 53 of the dielectric filter 50 of the present invention may be applied to a duplexer dielectric filter. FIG. 3 is a schematic perspective view of a duplexer dielectric filter 100 in accordance with the present invention.

As shown in FIG. 3, the duplexer dielectric filter 100 has a receiving area and a transmitting area, each area having a designated resonant frequency. The duplexer dielectric filter 100 is made of a dielectric block 101 including resonant holes 105*a* to 105*c* for the receiving area and resonant holes 105*d* to 105*g* for the transmitting area. Input and output terminals 121 and 123 and an antenna terminal 122 is extended from a first surface 103 to a lower side surface being separated from a conductive material deposited on the side surface.

Identically with FIG. 2, the duplexer dielectric filter 100 shown in FIG. 3 comprises first conductive patterns 115*a* to 115*g* formed around the corresponding resonant holes 105*a* to 105*g,* a second conductive pattern 111 formed below the resonant holes 105*d* to 105*g* of the transmitting area in a direction of arranging the resonant holes 105*d* to 105*g,* and third conductive patterns 131 and 135 disposed in an upward and/or downward direction from the resonant holes 105*a* to 105*g*. In order to assure a resonant frequency in the receiving area higher than a resonant frequency in the transmitting area, the duplexer dielectric filter 100 further comprises fourth conductive patterns 137 for connecting the upper side surface to the lower side surface between the resonators 105*a* to 105*g*.

In case of the duplexer dielectric filter 100, when a loading capacitance is adjusted in order to adjust characteristics of the resonant frequency during a manufacturing process or in a step prior to an application step, the trimming step for adjusting the lengths of the third conductive patterns 131 and 135 and the fourth conductive patterns 137 is essentially performed.

However, as shown in FIG. 3, the first to fourth conductive patterns 115 to 115*g,* 111, 131, 135, and 137 are limited within the open first surface 103 of the dielectric block 101, and densely formed on the open first surface 103 in very complicated patterns. Therefore, widths and intervals among the conductive patterns 115 to 115*g,* 111, 131, 135, and 137 are very narrow. In case of a recently miniaturized duplexer dielectric filter, the widths between the conductive patterns are very narrow at approximately 0.09 mm.

In case of the aforementioned narrow width between the conductive patterns, very small-sized metal segments generated in trimming the conductive patterns are sufficient to connect the narrow width between the conductive patterns, thereby causing short circuits between the patterns.

Therefore in the present invention, electrical effects such as short circuits due to the metal segments generated in the trimming step are prevented by forming a protection layer 130 made of a thermosetting resin being non-conductive on the open first surface 103 of the duplexer dielectric filter 100.

Particularly, differently from the protection layer 70 applied to the dielectric filter 50 of FIG. 2, the protection layer 130 applied to the duplexer dielectric filter 100 is preferably formed on the open first surface 103 except for a lower end portion 103*a* where the input and output terminals 121 and 123 and the antenna terminal 122 are formed. That is, as shown in FIG. 3, the input and output terminals 121 and 123 and the antenna terminal 122 are extended to the lower side surface. In order to mount the duplexer dielectric filter 100 on a printed circuit board, the lower end portion 103*a* of the open first surface 103 is used to contact an adhesive solder. Therefore, preferably, the protection layer 130 is formed on the open first surface 103 except for the lower end portion 103*a* required to mount the duplexer dielectric filter 100 on the printed circuit board.

FIGS. 4*a* to 4*d* are schematic views illustrating a method for manufacturing a dielectric filter, particularly a duplexer dielectric filter, in accordance with the present invention.

Figure 4A:
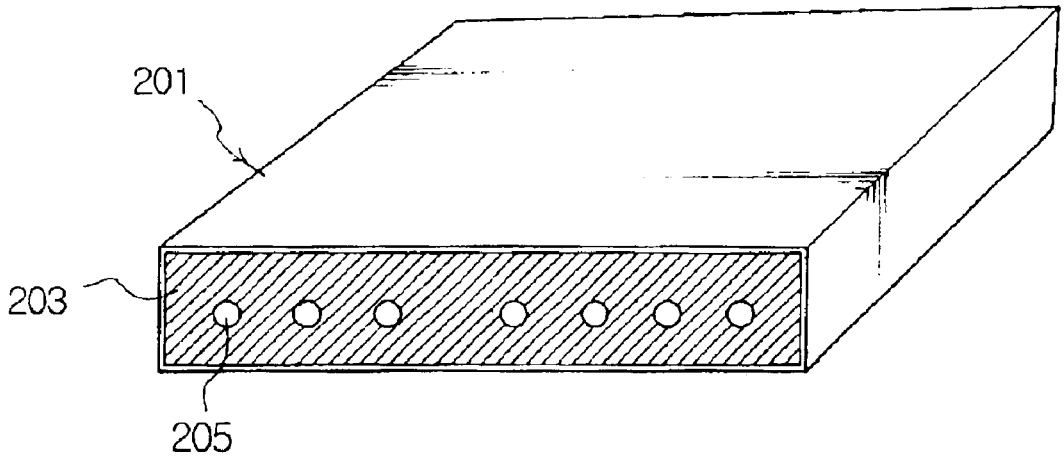
FIGS. 4*a* to 4*d* are schematic views illustrating a method for manufacturing a duplexer dielectric filter in accordance with the present invention.

As shown in FIG. 4*a,* a dielectric block 201 has a first surface 203, a second surface being opposite to the first surface 203, and side surfaces disposed therebetween. Resonant holes 205 arranged in parallel are disposed to pass through the first surface 203 and the second surface.

A conductive material is deposited entirely on the side surfaces and the second surface so as to expose the first surface 203 to the outside. Although not shown in detail in drawings, the conductive material is deposited on the interior surfaces of the resonant holes 205 so as to form resonators.

Figure 4B:
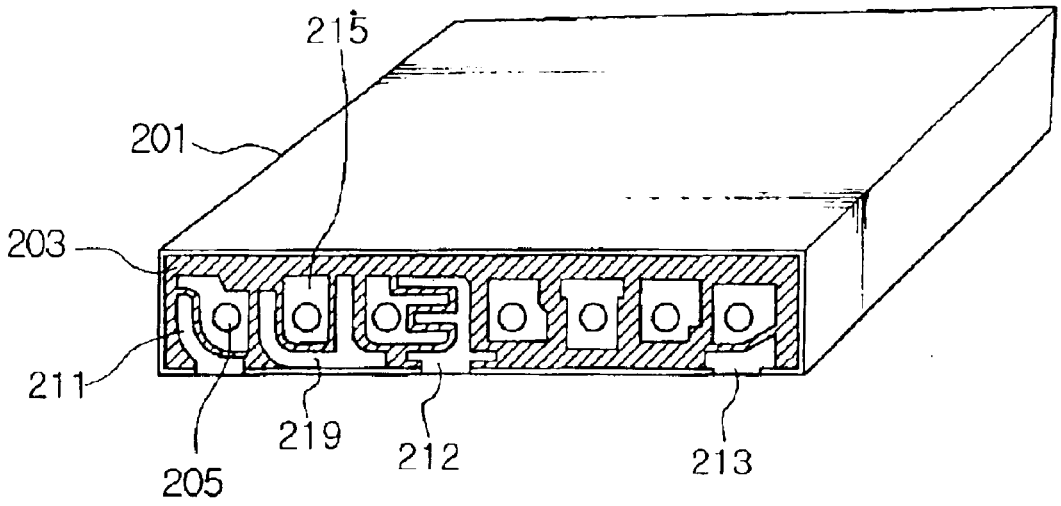

As shown in FIG. 4*b,* conductive patterns 215 and 219 are formed on the first surface 203 in various patterns so as to obtain a desired resonant frequency. The first conductive patterns 215 are formed around the resonant holes 205 being connected to the conductive material within the resonant holes 205 so as to adjust the loading capacitances of resonators or coupling capacitances between the resonators, and the second conductive patterns 219 are formed so as to adjust capacitances between the resonant holes 205 and between the resonant holes 205 and the side surfaces of the dielectric block 201. Herein, if necessary, in order to form a larger coupling capacitance with the conductive patterns of the same size and area, the first conductive patterns 215 may have curved surfaces.

Further, patterns 211, 212, and 213 are formed on the open first surface 203 of the dielectric block 201 so as to be connected to receiving and transmitting terminals and an antenna terminal. As shown in FIG. 4*b,* each pattern may be formed in various shapes in consideration of its electrical effects on neighboring resonators. As aforementioned, the conductive patterns with different shapes and functions may be formed in various manners within a narrow area of the open surface of the miniaturized dielectric filter.

If necessary, a step for forming an additional open area on the second surface (not shown in FIG. 4*b*) may be further added. Thereby, loading capacitances and coupling capacitances can be adjusted in various manners.

Figure 4C:
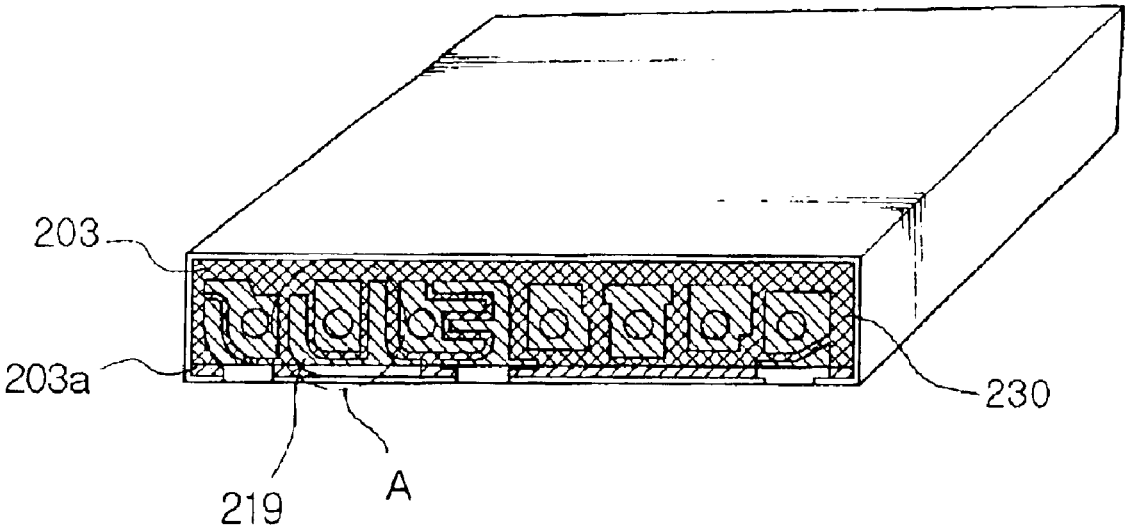

As shown in FIG. 4*c,* after forming the conductive patterns on the open first surface 203, a protection layer 230 is formed on the open first surface 203 so as to protect the open first surface 203 from external stresses. The protection layer 230 is formed by depositing a non-conductive thermosetting resin on the open first surface 203 and then curing the thermosetting resin. Herein, a thermosetting solder resist ink generally used in a process for manufacturing a printed circuit board may be used as the thermosetting resin for forming the protection layer 230.

The protection layer 230 used in the present invention serves to protect the dielectric filter from a fatal defect due to the metal segments generated in the tuning step of the dielectric filter, as well as to protect a finished product from external stresses in the same way as a protection layer applied to a conventional device.

As shown in FIG. 4*c,* preferably, the protection layer 230 is formed on the open first surface 203 except for a lower end portion 203*a* adjacent to the lower side surface. When the dielectric filter is mounted on a printed circuit board, the receiving and transmitting terminals 211 and 213 and the antenna terminal 212 extended to the lower side surface are mounted on the printed circuit board and soldered to the printed circuit board by a reflow process. Herein, the lower end portion 203*a* adjacent to the lower side surface provided with the terminals 211, 213, and 212 must be soldered to the printed circuit board so as to assure the stable electrical and mechanical connection between the dielectric filter and the printed circuit board.

For this purpose, in case of the duplexer dielectric filter having the terminals formed on the open surface 203 and extended to the side surface adjacent to the open surface 203, when the protection layer 230 is formed on the entire surface of the open surface 203, the stable soldering of the dielectric filter to the printed circuit board is made difficult and defects may be generated after the mounting step. Therefore, preferably, an area for forming the protection layer 230 is limited to the first surface 203 except for the lower end portion 203*a* adjacent to the terminals formed on the side surface, the portion 203*a* being required in the soldering of the dielectric filter to the printed circuit board.

Hereinafter, functions of the protection layer applied to the present invention will be described in detail with reference to FIG. 4*d.*

The dielectric block 201 produced by the step shown in FIG. 4*b* and provided with the conductive patterns formed by depositing the conductive material such as Ag paste goes through the firing step. During the firing step, the resonant frequency may be slightly changed by the change of dielectric constant of the dielectric block 201 and the contraction of the dielectric block 201 due to the effects of heat and pressure. Therefore, a process for manufacturing a dielectric filter essentially comprises a precise tuning step for supplying a precise resonant frequency. In order to precisely adjust the resonant frequency, the conductive patterns are selectively removed by the trimming step. When the metal segments cut from the conductive patterns are disposed on the open area of the first surface 203, the metal segments cause unintentional electrical defects, and more severely a fatal defect such as a short circuit between the two separated patterns.

Figure 4D:
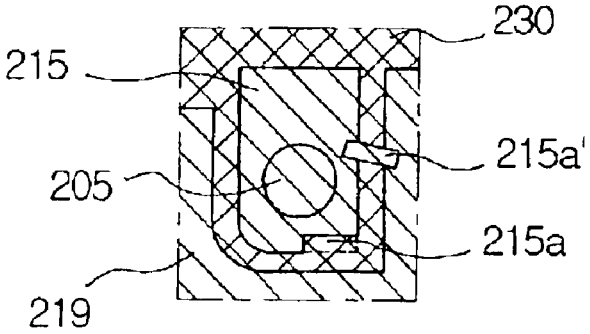

However, as shown in FIG. 4*d,* in case the resonant frequency is adjusted by removing a part 215*a* of the first conductive patterns 215 formed around the resonant holes 205, although a metal segment 215*a*' cut from the part 215*a* of the first conductive patterns 215 is disposed between the two separated conductive patterns on the open first surface 203, the metal segment 215*a*' is not directly connected to the patterns due to the protection layer 230. Therefore, the fatal defect generated in the conventional case is prevented. Further, since the trimming step on the open first surface 203 is stably performed by the protection layer 230, the present invention is advantageous in terms of miniaturization of the dielectric filter.

As apparent from the above description, the dielectric filter and the duplexer dielectric filter of the present invention comprise a protection layer formed by depositing a thermosetting resin on an open area, thereby protecting conductive patterns formed on the open area from external mechanical stresses and electrical defects caused by metal segments generated in a trimming step, particularly those caused in a miniaturized dielectric filter having narrow width and interval between conductive patterns.

Conventionally, in case the interval between the patterns formed on the open area is reduced to approximately less than 0.09 mm, a short circuit between the patterns frequently occurs during the trimming step, thereby being disadvantageous in terms of miniaturization of the dielectric filter. However, in the dielectric filter provided with the protection layer in accordance with the prevent invention, although the interval between the patterns is reduced to approximately 0.04 mm, defects such as the short circuit scarcely occur. Therefore, the present invention is advantageous in terms of miniaturization of the dielectric filter.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A dielectric filter having a designated resonant frequency, said filter comprising:

a dielectric block having a first surface, a second surface being opposite to the first surface, and side surfaces disposed between the first and second surfaces, the side surfaces and the second surface being deposited with a conductive material;

a plurality of resonators including resonant holes passing through the first and second surfaces of the dielectric block, being arranged in parallel, and having interior surfaces being deposited with a conductor;

input and output terminals formed on the side surfaces of the dielectric block while being separated from the conductive material deposited on the side surfaces;

conductive patterns formed on at least a part of the area of the first surface so that the resonators have a desired resonant frequency by changing capacitances of the resonators and/or between the resonators; and a protection layer formed on the first surface provided with the conductive patterns by depositing a thermosetting resin thereon, wherein said protection layer covers the whole surface of the conductive patterns.

2. The dielectric filter as set forth in claim 1, further comprising an open area formed on at least a part of the area of the second surface so that the resonators have a desired resonant frequency by changing capacitances of the resonators and/or between the resonators.

3. The dielectric filter as set forth in claim 1, wherein the protection layer is made of a thermosetting solder resist ink.

4. A duplexer dielectric filter provided with a transmitting area and a receiving area, each having a designated resonant frequency, said filter comprising:

a dielectric block having a first surface, a second surface being opposite to the first surface, and side surfaces disposed between the first and second surfaces, the side surfaces and the second surface being deposited with a conductive material;

a plurality of resonators including resonant holes divided into the transmitting and receiving areas so that each of said transmitting and receiving areas includes at least one of said resonant holes, said resonant holes passing through the first and second surfaces of the dielectric block, being arranged in parallel, and having interiors surfaces being deposited with a conductor;

input and output terminals and an antenna terminal, formed on the first surface and extended to one of the side surfaces adjacent to the first surface of the dielectric block while being separated from the conductive material deposited on the side surface;

conductive patterns formed on at least a part of the area of the first surface so that the resonators have a desired resonant frequency by changing capacitances of the resonators and/or between the resonators of the transmitting area and/or the receiving area; and a protection layer formed on the first surface provided with the conductive patterns by depositing a thermosetting resin thereon, wherein said protection layer covers the whole surface of the conductive patterns.

5. The duplexer dielectric filter as set forth in claim 4, wherein the protection layer is formed on the first surface except for an area of the first surface for being soldered to a printed circuit board when the duplexer dielectric filter is mounted on the printed circuit board, said area being adjacent to the side surface provided with the input and output terminals and the antenna terminal.

6. The duplexer dielectric filter as set forth in claim 4, further comprising an open area formed on at least a pall of the area of the second surface so that the resonators have a desired resonant frequency by changing capacitances of the resonators and/or between the resonators of the transmitting area and/or the receiving area.

7. The duplexer dielectric filter as set forth in claim 4, wherein the protection layer is made of a thermosetting solder resist ink.

8. A method for manufacturing a dielectric filter having a designated resonant frequency, said method comprising the steps of;

forming a dielectric block having a first surface, a second surface being opposite to the first surface, and side surfaces disposed between the first and second surfaces;

depositing a conductor on the side surfaces and the second surface of the dielectric block, and forming a plurality of resonators including resonant holes passing through the first and second surfaces of the dielectric block, being arranged in parallel, and having interior surfaces deposited with the conductor;

forming input and output terminals on the side surfaces of the dielectric block, and forming conductive patterns on at least a part of the area of the first surface so that the resonators have a desired resonant frequency by changing capacitances of the resonators and/or between the resonators, and depositing a thermosetting resin on the first surface provided with the conductive patterns so as to cover the whole surface of the conductive patterns, and curing the thermosetting resin.

9. The method for manufacturing a dielectric filter as set forth in claim 8, further comprising, after the step of depositing the thermosetting resin on the first surface and curing the thermosetting resin, the step of adjusting the resonant frequency of the dielectric filter by trimming the conductive patterns formed on the first surface of the dielectric block.

10. The method for manufacturing a dielectric filter as set forth in claim 8, wherein the step of forming conductive patterns on at least a part of the area of the first surface further comprises the step of forming an open area on at least a part of the area of the second surface.

11. The method for manufacturing a dielectric filter as set forth in claim 8, wherein the protection layer is made of a thermosetting solder resist ink.

12. A method for manufacturing a duplexer dielectric filter provided with a transmitting area and a receiving area, each having a designated resonant frequency, said method comprising the steps of:

forming a dielectric block having a first surface, a second surface being opposite to the first surface, and side surfaces disposed between the first and second surfaces;

depositing a conductor on the side surfaces and the second surface of the dielectric block, and forming a plurality of resonators including resonant holes passing through the first and second surfaces of the dielectric block, being arranged in parallel, and having interior surfaces deposited with the conductor, said resonators being divided into the transmitting and receiving areas;

forming input and output terminals and an antenna terminal on the first surface so that the terminals are extended to one of the side surfaces adjacent to the first surface of the dielectric block, and farming conductive patterns on at least a part of the area of the first surface so that the resonators have a desired resonant frequency by changing capacitances of the resonators and/or between the resonators of the transmitting area and/or the receiving area; and depositing a thermosetting resin on the first surface provided with the conductive patterns so as to cover the whole surface of the conductive patterns, and curing the thermosetting resin.

13. The method for manufacturing a duplexer dielectric filter as set forth in claim 12, wherein the thermosetting resin is deposited on the first surface except for an area for being soldered to a printed circuit board when the duplexer dielectric filter is mounted on the printed circuit board, said area being adjacent to the side surface provided with the input and output terminals and the antenna terminal.

14. The method for manufacturing a duplexer dielectric filter as set forth in claim 12, further comprising, after the step of depositing the thermosetting resin on the first surface and curing the thermosetting resin, the step of adjusting the resonant frequency of the dielectric filter by trimming the conductive patterns fanned on the first surface of the dielectric block.

15. The method for manufacturing a duplexer dielectric filter as set forth in claim 12, wherein the step of forming conductive patterns on at least a part of the area of the first surface further comprises the step of forming an open area on at least a part of the area of the second surface.

16. The method fur manufacturing a duplexer dielectric filter as set forth in claim 12, wherein the protection layer is made of a thermosetting solder resist ink.

* * * * *